US008870544B2

(12) United States Patent
Caprario

(10) Patent No.: US 8,870,544 B2
(45) Date of Patent: Oct. 28, 2014

(54) ROTOR COVER PLATE RETENTION METHOD

(75) Inventor: Joseph T. Caprario, Cromwell, CT (US)

(73) Assignee: United Technologies Corporation, Hartford, CT (US)

( * ) Notice: Subject to any disclaimer, the term of this patent is extended or adjusted under 35 U.S.C. 154(b) by 1043 days.

(21) Appl. No.: 12/846,304

(22) Filed: Jul. 29, 2010

(65) Prior Publication Data

US 2012/0027598 A1 Feb. 2, 2012

(51) Int. Cl.
*F01D 5/00* (2006.01)
*F01D 5/08* (2006.01)

(52) U.S. Cl.
CPC ..... *F01D 5/082* (2013.01); *F05D 2260/30* (2013.01)
USPC ..... 416/220 R; 416/244 R

(58) Field of Classification Search
CPC ..... F01D 5/082; F05D 2260/30
USPC ..... 416/204 A, 218, 220 R, 244 A, 244 R, 416/248
See application file for complete search history.

(56) References Cited

U.S. PATENT DOCUMENTS

| | | | | |
|---|---|---|---|---|
| 3,768,924 | A | 10/1973 | Corsmeier et al. | |
| 4,304,523 | A | 12/1981 | Corsmeier et al. | |
| 4,349,318 | A | 9/1982 | Libertini et al. | |
| 4,558,988 | A | 12/1985 | Kisling et al. | |
| 4,701,105 | A | 10/1987 | Cantor et al. | |
| 5,257,909 | A * | 11/1993 | Glynn et al. | 416/220 R |
| 5,330,324 | A * | 7/1994 | Agram et al. | 416/220 R |
| 5,338,154 | A * | 8/1994 | Meade et al. | 415/173.7 |
| 7,040,866 | B2 * | 5/2006 | Gagner | 416/220 R |
| 2009/0148295 | A1 | 6/2009 | Caprario et al. | |

* cited by examiner

*Primary Examiner* — Ned Landrum
*Assistant Examiner* — Woody A Lee, Jr.
(74) *Attorney, Agent, or Firm* — Carlson, Gaskey & Olds, P.C.

(57) ABSTRACT

A mechanism for use in a gas turbine engine has a cover plate, a rotor disk, a first slot in the cover plate, a second slot in the rotor disk, a first finger in the cover plate extending through the second slot, and a second finger in the rotor disk extending through the first slot. The first finger and the second finger form a channel and a holder is disposed in the channel for locking the rotor disk and the cover plate together.

18 Claims, 3 Drawing Sheets

ROTOR COVER PLATE RETENTION METHOD

BACKGROUND OF THE INVENTION

Gas turbine engines typically include a compressor that delivers compressed air to a combustor in which the compressed air is mixed with fuel and burned. The rapidly expanding products of combustion move through turbine blades causing them to rotate a shaft which provides rotative force to propeller or fan blades. Turbine rotors typically include a rotor disk and a plurality of circumferentially spaced removable turbine blades. Since the rotor disk and the turbine blades are subject to extreme temperatures, cooling air is typically delivered to these components to cool them.

Cooling air may be delivered from a central location to the rotor disk and then radially outwardly to internal passages within each turbine blades.

To seal cooling passages along the rotor disk, cover plates are typically attached to the rotor disk. Cover plates typically follow the contour of the disk to create a boundary layer effect that pumps cooling air from the central location to the radially outward location while the cover plate and rotor disk rotate.

SUMMARY OF THE INVENTION

A mechanism for use in a gas turbine engine has a cover plate, a rotor disk, a first slot in the cover plate, a second slot in the rotor disk, a first finger in the cover plate extending through the second slot, and a second finger in the rotor disk extending through the first slot. The first finger and the second finger form a channel and a holder is disposed in the channel for locking the rotor disk and the cover plate together.

A mechanism for use in rotating equipment has a first rotating body, a second rotating body, a first slot in the first rotating body, a second slot in the second rotating body, a first finger in the first body extending through the second slot, a second finger in the second body extending through the first slot wherein the first finger and the second finger form a channel and a holder disposed in the channel for locking the cover plate and the cover plate together.

A mechanism for use in rotating equipment has a first rotating body, a second rotating body, a first slot in the first rotating body, a second slot in the second rotating body, a first finger in the cover plate extending through the second slot, a second finger in the rotor disk extending through the first slot wherein the first finger and the second finger form a channel and a holder disposed in the channel for locking the cover plate and the cover plate together.

These and other features of the present invention can be best understood from the following specification and drawings, the following of which is a brief description.

DETAILED DESCRIPTION OF THE PREFERRED EMBODIMENT

Figure 1:
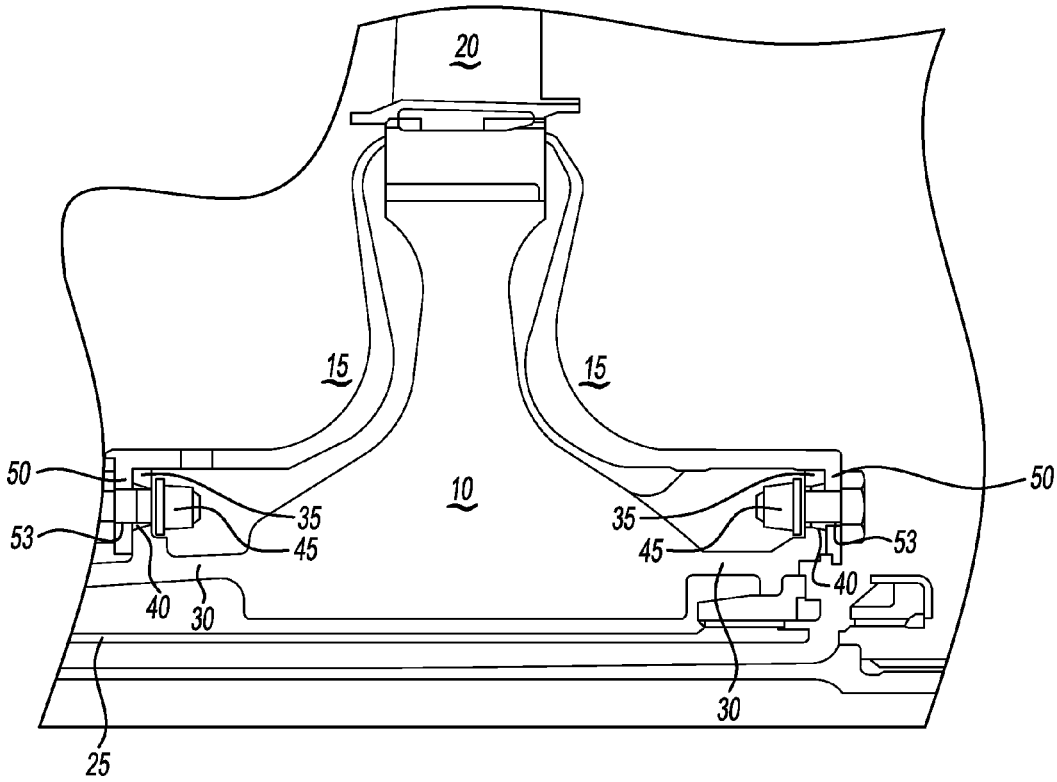
Fig-1 PRIOR ART
FIG. 1 is a cutaway view of a turbine rotor incorporating a prior art cover plate.
Figure 2:
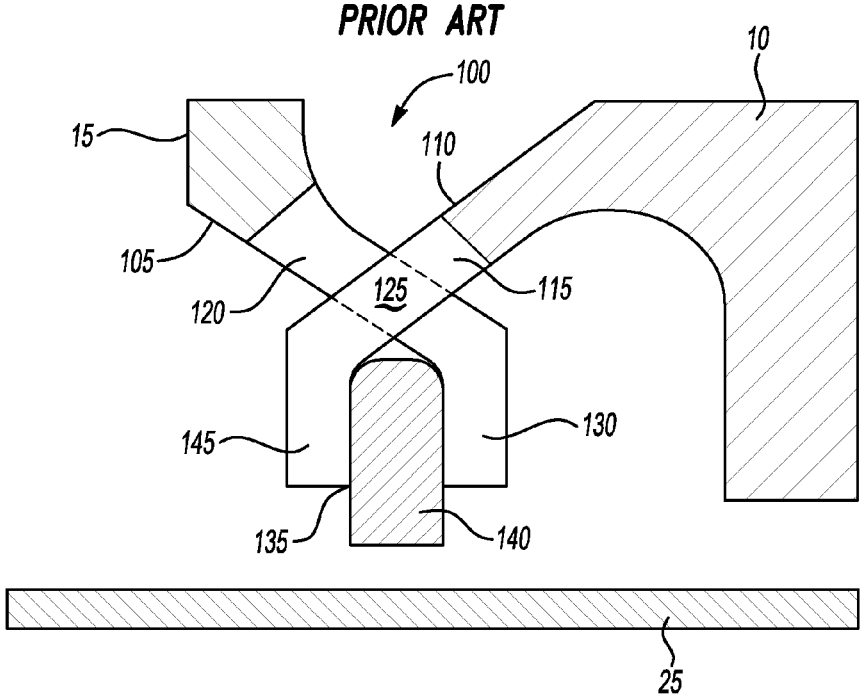
FIG. 2 is a functional, schematic cutaway view of a cover plate retention device.
Figure 3:
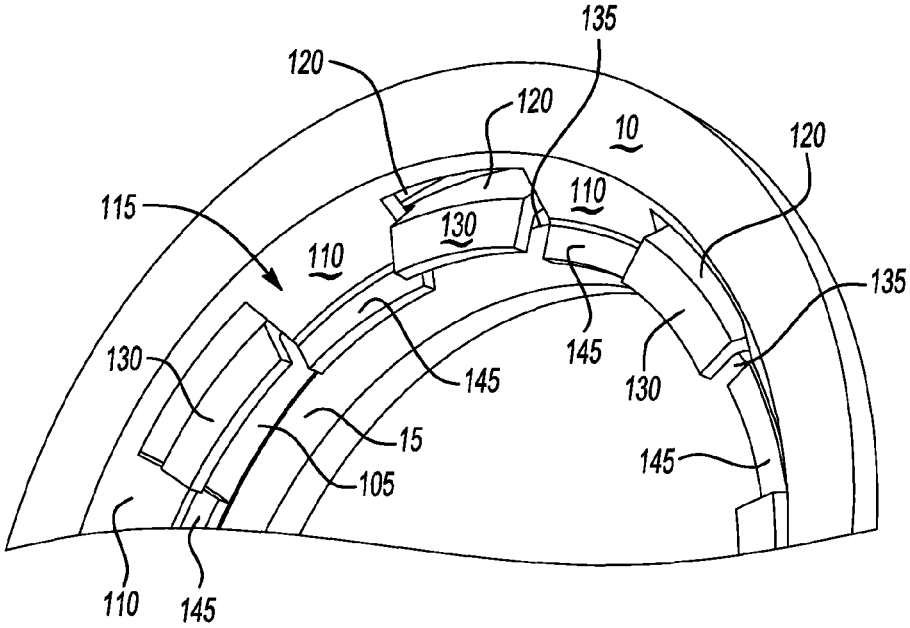
FIG. 3 is a schematic view of the cover plate retention device of FIG. 2.
Figure 4:
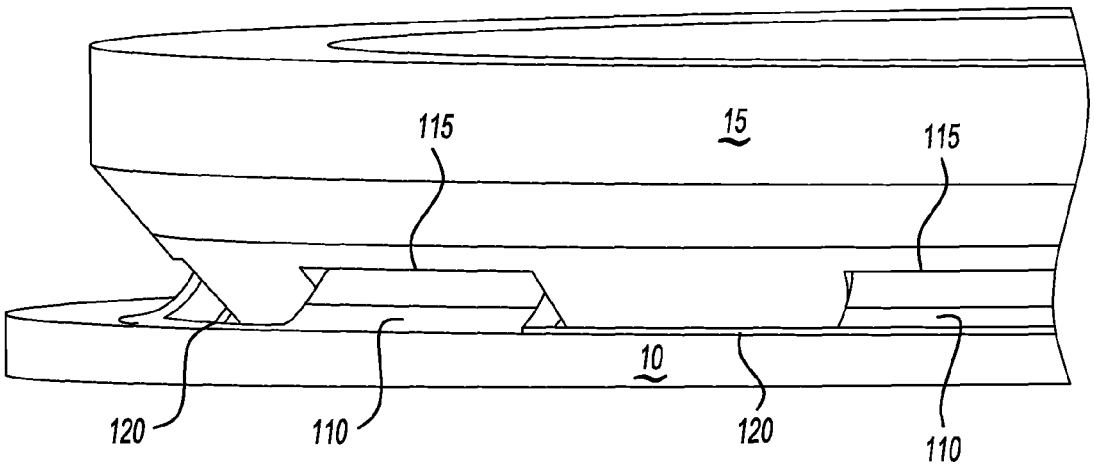
FIG. 4 is a perspective view of a portion of a cover plate extending through a portion of a rotor disk.
Figure 5:
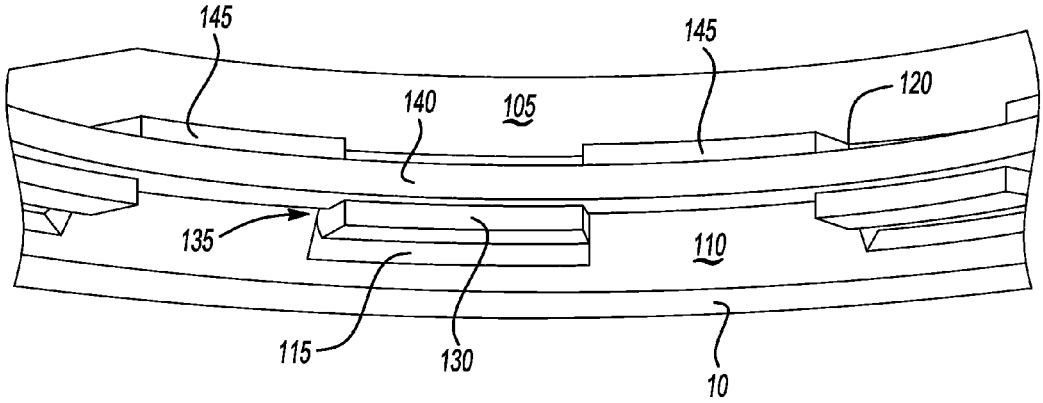
FIG. 5 is a perspective view of a portion of a rotor plate extending through a portion of a cover plate.

Referring now to FIG. 1, a prior art rotor disk 10, a pair of cover plates 15, and a turbine blade 20 are shown. The rotor disk 10 attaches to a shaft 25 by known means. Each rotor disk 10 has a pair of axially extending hubs 30. Each hub 30 has a radially extending flange 35 that has holes 40 therein for receiving bolts 45. Each cover plate 15 has a radially inwardly extending flange 50 having an holes 53 for mating with the radially extending hub 35 of the rotor disk 10 so that the bolts 45 may be extended through the radially extending flanges 35, 50 and join the cover plate to the rotor disk. Each cover plate 15, as is known in the art, is contoured closely to the shape of the rotor disk 10 so that air cooling may be distributed along the rotor disk 10 to the turbine blade 20. As the rotor disk 10 rotates so do the cover plates 15. Because of the axially extending flanges 30 and the axial length of the bolts 45 required, this configuration takes up significant axial room and involves multiple pieces.

Referring now to FIGS. 2-5, in an exemplar of a cover plate interlock mechanism 100 is shown. The interlock mechanism 100 includes a cover plate flange 105, a rotor disk flange 110 and a ring 140 which acts as a holder to hold or lock the cover plate 15 and the rotor plate 10 together. The cover plate flange 105 has a plurality of cover plate slots 115 and the rotor disk flange 110 has a plurality of rotor disk slots 120 as will be discussed herein for receiving the other of the cover plate flange 105 or the rotor disk flange 110. The retention ring 140 anchors the cover plate flange 105 and the rotor disk flange 110 within each of the other of the cover plate flange 105 and the rotor disk flange 110 as will be discussed herein. The rotor plate and the cover plate slots 115, 120 are openings between the cover plate flange 105 and the rotor disk flange 110 on each of the rotor disk 10 and the cover plate 15 so that the cover plate flange 105 or the rotor disk flange 110 of each of the rotor disk 10 and the cover plate 15 essentially interleave like fingers.

As shown in FIGS. 2-5, the cover plate flange 105 is angled radially and axially toward the rotor disk flange 110. Similarly the rotor disk flange 110 is angled radially and axially toward the cover plate flange 105. The cover plate flange 105 has a plurality of radial finger portions 130 and the rotor disk flange 110 has a plurality of radial finger portions 145, each radial finger portion extending through a slot in the other flange and perpendicular to the shaft 25 which forms a center line like intermeshed fingers. The radial finger portions 130, 145 on each flange 105, 110 form a roughly u-shaped channel 135 for receiving the retention ring 140.

The interlock mechanism 100 axially, radially, and angularly attaches cylindrical-like components, such as cover plates and disks as shown. Though a cover plate 15 is shown attaching to a rotor disk 10, the coupling of parts that may have other shapes by the interlock mechanism 100 is contemplated herein.

To assemble the interlock mechanism, the portions 125 of each flange 105, 110 of each of the cover plate 15 and the rotor disk 10 are interleaved through the slots 115. 120 formed between portions 125 of the other part. After interleaving is complete, the ring 140 is inserted in the channel 135 formed by the radial finger portions 130. The ring 140 may be split for ease of insertion.

Figure 6:
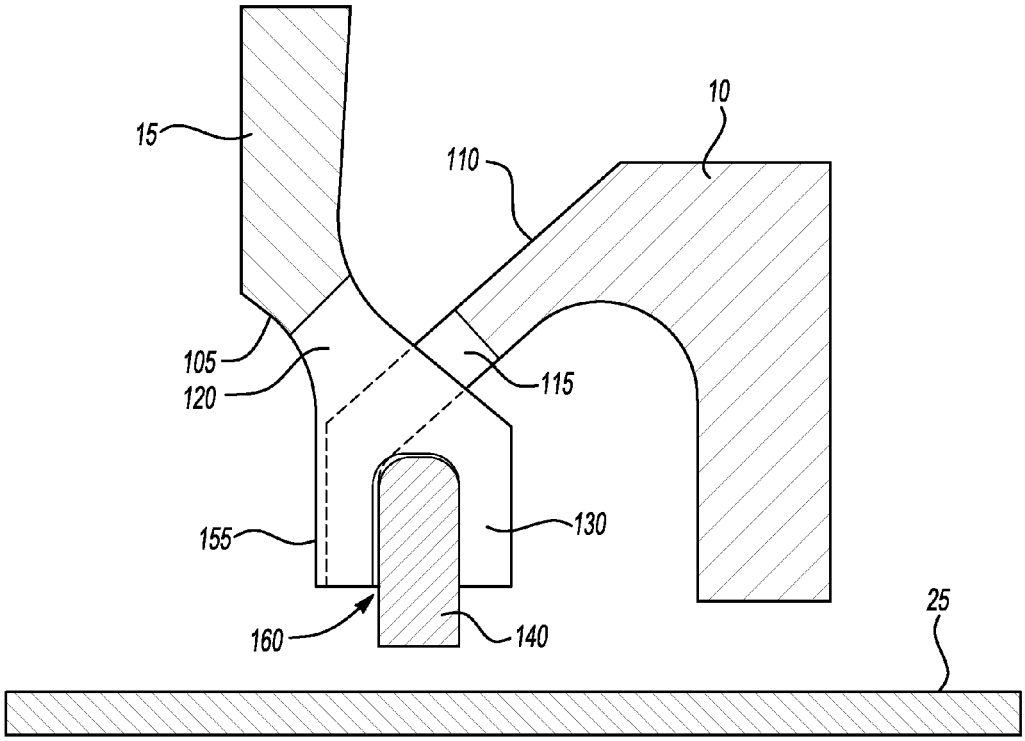
FIG. 6 is an alternative embodiment of the cover plate of FIG. 4.

Referring now to FIG. 6, a further example is shown. The cover plate flange 105 has a second radial finger portion 155 extending radially inwardly towards the shaft 25 such that the second radial finger portion 155 and the radial finger portion 130 form a fork 160 that holds the retention ring 140 therein. Though the cover plate flange 105 is shown having finger portions that form a fork, the rotor disk flange 110 may also have two finger portions forming a fork.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A mechanism for use in a gas turbine engine, the mechanism comprising;

a cover plate, a rotor disk, a first slot in the cover plate, a second slot in the rotor disk, a first finger in the cover plate extending through the second slot, a second finger in the rotor disk extending through the first slot wherein the first finger and the second finger form a first channel, a holder disposed in the channel for locking the rotor and the cover plate together wherein the first finger extends from a first axial side of the holder to a second axial side of the holder; and wherein the second finger extends from a second axial side of the holder to a first axial side of the holder.

2. The mechanism of claim 1 wherein the holder is a ring.

3. The mechanism of claim 1 wherein either of the first finger or the second finger forms a fork having a first side and a second side.

4. The mechanism of claim 3 wherein one of the first side or the second side of the fork extends through the first slot and/or the second slot.

5. The mechanism of claim 3 wherein the first side and the second side of the fork form a second channel.

6. The mechanism of claim 1 wherein either of the first finger or the second finger has a radially and axially extending angled portion extending through an other of the first slot and/or the second slot.

7. The mechanism of claim 6 wherein either of the finger or the second finger has a radial inward portion.

8. The mechanism of claim 1 wherein either of the finger or the second finger has a radial inward portion.

9. The mechanism of claim 8 wherein a plurality of said radial inward portion forms said first channel.

10. The mechanism of claim 1 wherein the first finger crosses the second finger.

11. The mechanism of claim 10 wherein the first finger crosses the second finger adjacent a radially outer end of the holder.

12. A mechanism for use in rotating equipment, the mechanism comprising;

a first rotating body, a second rotating body, a first slot in the first rotating body, a second slot in the second rotating body, a first finger in the first body extending through the second slot, a second finger in the second body extending through the first slot wherein the first finger and the second finger form a first channel, a holder disposed in the channel for locking a first rotating body and the second rotating body together wherein the first finger extends from a first axial side of the holder to a second axial side of the holder; and wherein the second finger extends from a second axial side of the holder to a first axial side of the holder.

13. The mechanism of claim 12 wherein either of the first finger or the second finger has a radially and axially extending angled portion extending through an other of the first slot and/or the second slot.

14. The mechanism of claim 13 wherein either of the finger or the second finger has a radial inward portion.

15. The mechanism of claim 12 wherein either of the finger or the second finger has a radial inward portion.

16. The mechanism of claim 15 wherein a plurality of said radial inward portion forms said first channel.

17. A joining mechanism comprising;

a first body, a second body, a first slot in the first body, a second slot in the second body, a first finger in the first body extending through the second slot, a second finger in the second body extending through the first slot wherein the first finger and the second finger form a first channel, a holder disposed in the channel for locking a first body and the second body together wherein the first finger extends from a first axial side of the holder to a second axial side of the holder; and wherein the second finger extends from a second axial side of the holder to a first axial side of the holder.

18. The mechanism of claim 17 wherein either of the first finger or the second finger forms a fork having a first side and a second side.

* * * * *